US008973553B2

(12) United States Patent
Estefanous

(10) Patent No.: US 8,973,553 B2
(45) Date of Patent: Mar. 10, 2015

(54) MULTI-SENSING FUEL INJECTION SYSTEM AND METHOD FOR MAKING THE SAME

(75) Inventor: Fadi Adly Anis Estefanous, Warren, MI (US)

(73) Assignee: Wayne State University, Detroit, MI (US)

( * ) Notice: Subject to any disclaimer, the term of this patent is extended or adjusted under 35 U.S.C. 154(b) by 412 days.

(21) Appl. No.: 13/386,028

(22) PCT Filed: Jul. 20, 2010

(86) PCT No.: PCT/US2010/042549

§ 371 (c)(1), (2), (4) Date: Apr. 2, 2012

(87) PCT Pub. No.: WO2011/011378

PCT Pub. Date: Jan. 27, 2011

(65) Prior Publication Data

US 2012/0180756 A1 Jul. 19, 2012

Related U.S. Application Data

(60) Provisional application No. 61/226,920, filed on Jul. 20, 2009.

(51) Int. Cl.

| | |
|---|---|
| ***F02M 61/16*** | (2006.01) |
| ***F02M 57/00*** | (2006.01) |
| ***F02D 35/02*** | (2006.01) |
| *F02P 17/12* | (2006.01) |

(52) U.S. Cl.

CPC ..... *F02D 35/02* (2013.01); *F02D 35/028* (2013.01); *F02M 57/005* (2013.01); *F02M 2200/24* (2013.01); *F02P 2017/125* (2013.01)

USPC ..... 123/294; 73/114.45

(58) Field of Classification Search

USPC ..... 123/294, 478–480, 490, 498, 198 D, 123/198 DB; 701/103, 104, 107; 73/35.08, 73/114.45, 114.49, 114.58, 114.67

See application file for complete search history.

(56) References Cited

U.S. PATENT DOCUMENTS

| | | | | |
|---|---|---|---|---|
| 4,727,843 | A | 3/1988 | Petersen et al. | |
| 5,076,242 | A | 12/1991 | Parker | |
| 5,834,629 | A | 11/1998 | Hammarberg | |
| 6,234,002 | B1 * | 5/2001 | Sisney et al. | 73/1.57 |
| 6,326,595 | B2 | 12/2001 | Taniguchi et al. | |
| 6,565,020 | B1 * | 5/2003 | Fischer et al. | 239/585.1 |
| 6,761,059 | B2 * | 7/2004 | Hsia et al. | 73/114.45 |

(Continued)

OTHER PUBLICATIONS

International Search Report for PCT/US2010/042549, Dated Sep. 9, 2010.

*Primary Examiner* — John Kwon
*Assistant Examiner* — Johnny H Hoang
(74) *Attorney, Agent, or Firm* — Brinks Gilson & Lione

(57) ABSTRACT

A multi-sensing fuel injection system for internal combustion engines. The system includes a fuel injector for injecting fuel into the internal combustion chamber. The fuel injector is electrically insulated from an engine body of the internal combustion engine by way of a first electrically insulated member. A second electrically insulated member is provided for fixedly disposing the fuel injector within the combustion chamber. The electrical insulation of the fuel injector, in conjunction with the integration of an ion sensing circuit including a resistor and a power source for supplying voltage to the fuel injector, allows for a full measurement of the ionization current.

15 Claims, 16 Drawing Sheets

(56) References Cited

U.S. PATENT DOCUMENTS

| | | | | |
|---|---|---|---|---|
| 6,769,408 | B2 | 8/2004 | Krome et al. | |
| 6,994,073 | B2 | 2/2006 | Tozzi et al. | |
| 7,150,410 | B1 | 12/2006 | Straub | |
| 7,204,133 | B2 | 4/2007 | Benson et al. | |
| 7,216,630 | B2 * | 5/2007 | Martin et al. | 123/467 |
| 7,309,025 | B2 | 12/2007 | Yamazaki et al. | |
| 7,430,899 | B2 * | 10/2008 | Kekedjian et al. | 73/114.45 |
| 7,784,445 | B2 * | 8/2010 | Takahashi et al. | 123/479 |
| 8,590,513 | B2 * | 11/2013 | Kondo et al. | 123/494 |
| 8,688,353 | B2 * | 4/2014 | Morimoto et al. | 701/103 |
| 2004/0150169 | A1 | 8/2004 | Matsumoto et al. | |
| 2005/0119819 | A1 * | 6/2005 | Stevens | 701/104 |
| 2007/0028869 | A1 | 2/2007 | Brahim et al. | |
| 2008/0065306 | A1 * | 3/2008 | Takahashi et al. | 701/101 |
| 2009/0118982 | A1 * | 5/2009 | Kondo et al. | 701/104 |
| 2011/0264356 | A1 * | 10/2011 | Korenaga et al. | 701/104 |

* cited by examiner

MULTI-SENSING FUEL INJECTION SYSTEM AND METHOD FOR MAKING THE SAME

CROSS-REFERENCES TO RELATED APPLICATIONS

The present application claims the benefit of priority to PCT Application No. PCT/US2010/042549, filed Jul. 20, 2010, which application claims the benefit of U.S. Provisional Patent Application No. 61/226,920, filed Jul. 20, 2009, the entirety of which is hereby incorporated by reference.

FEDERALLY SPONSORED RESEARCH AND DEVELOPMENT

This invention was made with Government support under Contract No. W56HZV-08-C-0627 awarded by the U.S. Army. The Government has certain rights in the invention.

FIELD OF THE INVENTION

The present invention relates generally to a sensing apparatus, and more particularly, to an electrically isolated fuel injector for internal combustion engines.

BACKGROUND

Internal combustion engines such as those used in diesel powered vehicles are typically ignited by a mixture of injected fuel and hot compressed air. While diesel engines provide higher thermal efficiency than spark-ignited gasoline engines, for instance, diesel engines are known to emit undesirable exhaust emissions, such as high levels of nitrogen oxide ($NO_x$) and black particulate smoke, which are undesirable. Thus, government agencies require diesel engines to meet strict regulations regarding the quantity of exhaust emissions in an effort to reduce pollutants in the environment. The environmental emissions regulations for these engines are becoming more stringent and difficult to meet, particularly for emissions resulting from fossil fuel combustion.

There is a need to monitor and control the combustion process, not only to reduce engine-out emissions, but also to produce the exhaust gas composition and temperature necessary to enhance the operation of after treatment-devices used to reduce emissions.

SUMMARY

There is a need in the art for an improved system for detecting ionization current to control diesel engine combustion. The precise control of the combustion process in combustion engines requires a feedback signal indicative of the combustion process. One commonly considered signal is the cylinder gas pressure, measured by a quartz crystal pressure transducer, or other types of pressure transducers. The use of cylinder pressure transducers, however, is generally limited to laboratory settings and is not favored in practice due to its relatively high cost and limited durability under actual operating conditions.

Of the measuring methods known for detecting engine combustion conditions during engine operation, ion current measurement has been considered to be highly useful because it can be used for directly observing the chemical reaction resulting from the engine combustion. As such, an in-cylinder ionization sensor may be employed to sense various engine parameters according to different engine operating conditions. For instance, ionization sensors are operable to detect the combustion process based on the theory that positive and negative ions are generated during the combustion process. Thus, ionization sensors can replace many sensors commonly integrated in diesel engines, particularly the expensive pressure transducers discussed above.

In gasoline operated engine, for instance, spark plugs may be used to detect ionization current (e.g., a spark plug with a central electrode and one or more spaced apart side electrodes). In diesel operated engines, on the other hand, a glow plug can be used to sense the ion current. For instance, a glow may be modified so as to be electrically insulated from the engine body, wherein the glow plug and engine body each acts as an electrode. Alternatively, it may be possible to incorporate an ionization sensor into an orifice of a glow plug. By way of example, an electric conductive layer made of platinum may be formed on a surface of a heating element of the glow plug, wherein the layer is electrically insulated from the combustion chamber and a glow plug clamping fixture. The foregoing combination is a feasible technology for production and provides several key benefits. For instance, modifications to the engine may not be required, and the location of the glow plug is well-suited for sensing. Nonetheless, due to thermal and magnetic conditions in or near the glow plug, typical ionization conditioning circuitry has been positioned at substantial protective distances from the glow plug. Unfortunately, these protective distances further degrade a typically weak signal, and thus reduce the signal-to-noise ratio of the detected ionization signal before reaching the ionization conditioning circuitry. In addition, soot deposits formed on surfaces of the glow plug further degrade the integrity of the signal.

The present invention provides an improved ion sensing system for detecting ionization current in a combustion chamber of a compression-ignited engine such as, but not limited to, a diesel engine or a homogeneous charge compression ignition (HCCI) engine. The system includes an electrically insulated fuel injector disposed within a combustion chamber of an internal combustion engine. The fuel injector provides fuel to an engine cylinder in response to receiving an injection signal from an electronic controller operatively connected thereto. A first electrically insulated member is provided for electrically isolating the fuel injector from the body of the internal combustion engine. A second electrically insulated member is provided for fixedly positioning the fuel injector within the combustion chamber.

The system further includes an ionization detection circuit for sensing ionization current. The ionization detection circuit includes a power source for supplying power to the fuel injector. The power source is electrically connected to the fuel injector via a first terminal having a preset positive potential, and is electrically connected to the engine body via a second terminal.

Additional benefits and advantages of the present invention will become apparent to those skilled in the art to which the invention relates from the subsequent description of the preferred embodiment and the appended claims, taken in conjunction with the accompanying drawings.

DETAILED DESCRIPTION

Figure 1:
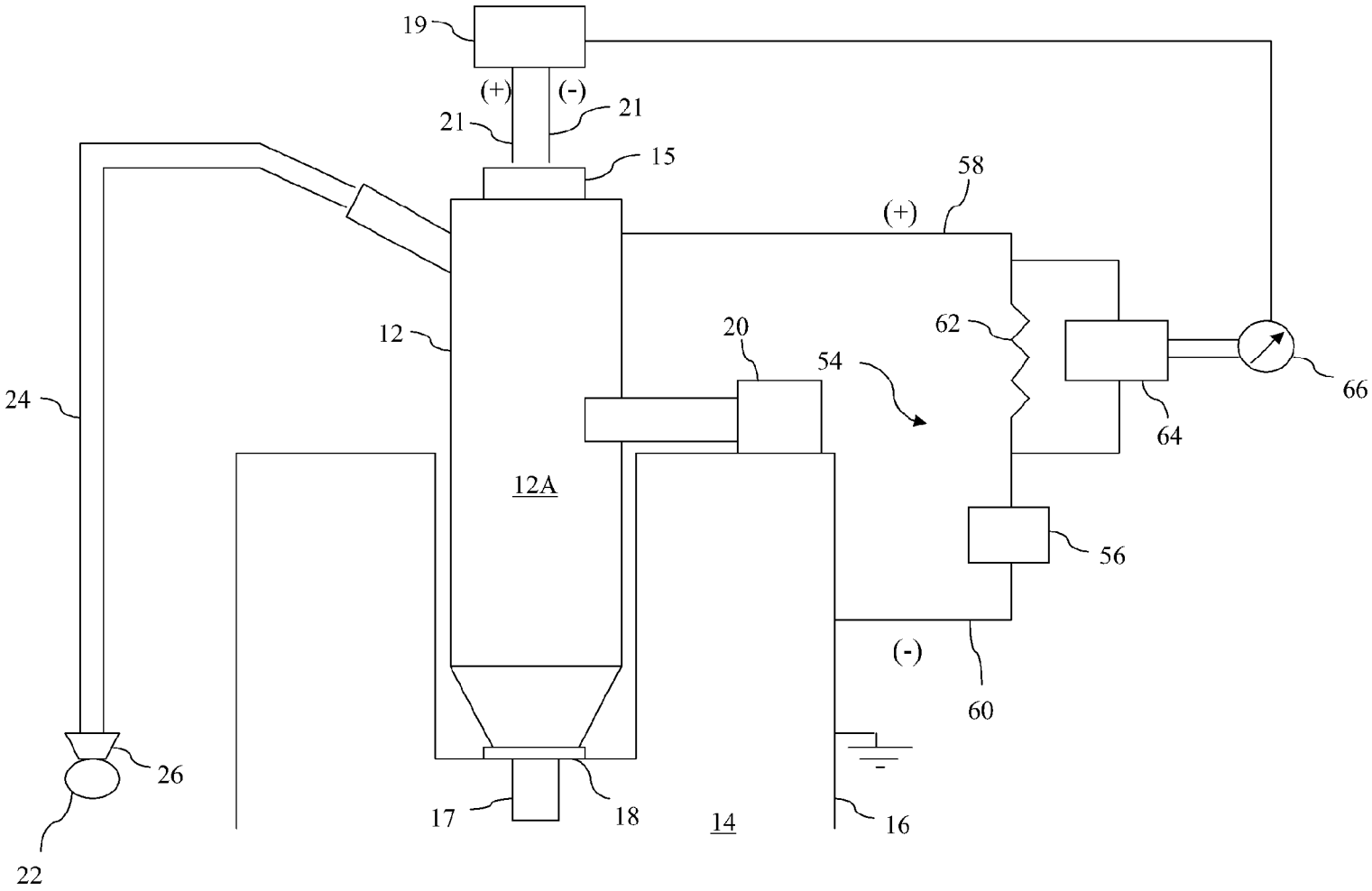
FIG. 1 is a schematic view of a system for detecting ionization current in accordance with the present invention.

Referring now to FIG. 1, a system embodying principles of the present invention is illustrated therein and designated generally by reference numeral 10. In one embodiment, the system 10 includes a fuel injector 12 for injecting fuel in a combustion chamber 14 formed in an engine body 16 of an engine having at least one cylinder. The engine is preferably an internal combustion engine such as a diesel engine. As used herein, it is to be understood that the term "engine" is to be broadly construed and may refer to typical diesel engines, HCCI engines, dual mode engines, flexible-fuel engines, dual-fuel engines, direct injection gasoline engines, hydrogen engines, etc.

In this embodiment, the fuel injector 12 is coupled to a solenoid 15 operable to drive a needle (not shown) for injecting fuel from a nozzle 17. The solenoid 15 may be a two position on/off valve, a piezoelectric valve, or any suitable valve known to those of ordinary skill in the art. An electronic control unit (ECU) 19 for controlling the engine is electrically connected to the solenoid 15 via solenoid terminals 21. It is to be understood that the ECU 19 may be any suitable control device known to those of ordinary skill in the art. For instance, the ECU may include a microprocessor having a central processing unit (CPU), storage media such as read-only memory (ROM) and random-access memory (RAM), input/output circuits, etc. The solenoid terminals 21 are electrically insulated from the fuel injector 12 and serve as the electric wiring for carrying an energizing current for driving the needle to inject fuel through the nozzle 17. As will be understood to those skilled in the art, the injection of fuel assists in the removal of soot deposits formed onto external surfaces of an orifice of the fuel injector.

The fuel injector 12 is insulated from the engine body 16 by way of a first electrically insulated member such as a washer 18. The washer 18 may be composed of an electrically insulating material or may be formed as a metal having an electrically insulating coating. According to one aspect of the invention, a second electrically insulated member may be provided for securely fixing the fuel injector 12 in place. As shown in FIG. 1, for example, the second electrically insulating member includes a fork 20 mounted on the engine body 16 and connected to the body 12A of the fuel injector 12 so as to ensure electrical isolation therefrom. The fork may be composed of an electrically insulating material or may be formed as a metal having an electrically insulating coating.

The fuel injector 12 is fluidly connected to a fuel pump 22 via a fuel line 24. The fuel pump 22 is driven by an output shaft (not shown) and is operable to supply fuel to the fuel injector 12 through the fuel line 24. According to one embodiment of the invention, the fuel line 24 is electrically insulated from the fuel pump 22 by way of a third electrically insulating member. In FIG. 1, for example, the third electrically insulating member includes an insulating member such as a washer or a ferrule 26 disposed between the fuel pump 22 and a proximal end of the fuel line 24. The ferrule 26 may be composed of an electrically insulating material or may be formed as a metal having an electrically insulating coating.

Figure 2:
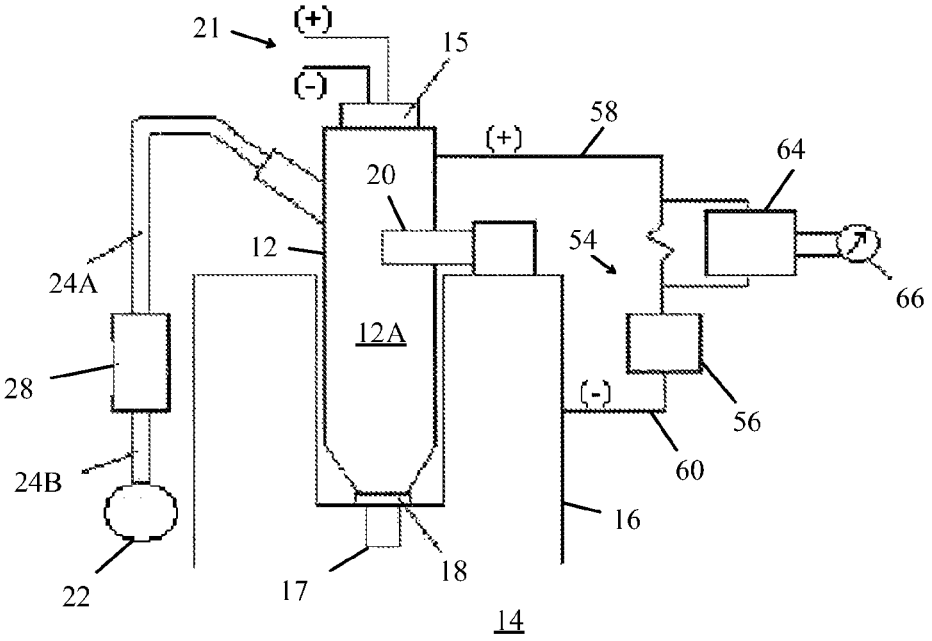
FIG. 2 is a schematic view of a system for detecting ionization current in accordance with an alternative embodiment of the present invention.

According to an alternative embodiment of the invention, a high pressure coupling 28 is provided for electrically insulating part of the fuel line 24 from the fuel pump 22. As best shown in FIG. 2, the high pressure coupling 28 is disposed between the proximal end of the fuel line 24 and a distal end thereof. Thus, it can be seen that an isolated part 24A of the fuel line 24 extending from the fuel injector 12 to the high pressure coupling 28 is electrically insulated from the fuel pump 22, and hence, the engine body 16. In contrast, a non-isolated part 24B of the fuel line 24 extending from the high pressure coupling 28 to the fuel pump 22 is not electrically insulated from the engine body 16.

Figure 3:
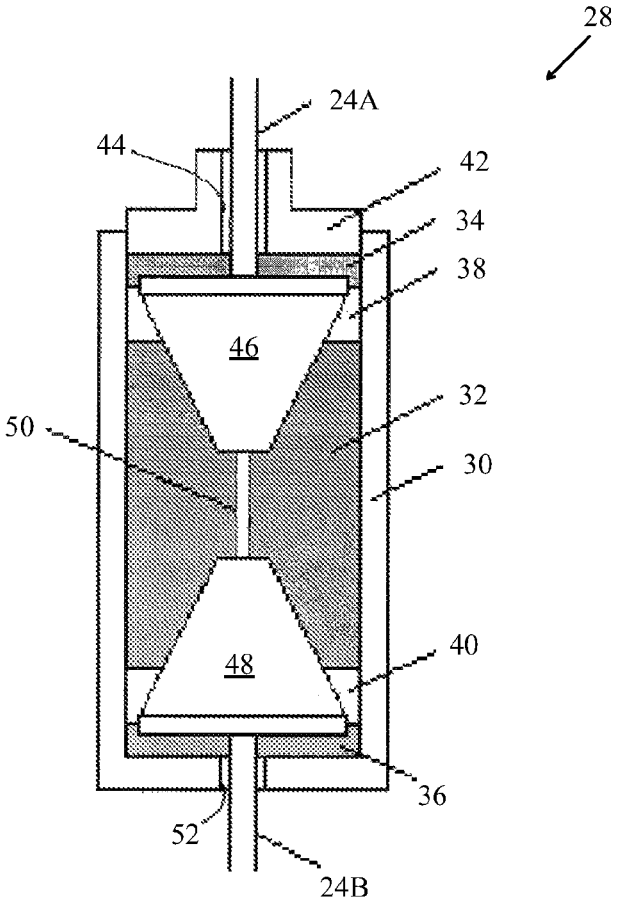
FIG. 3 is an enlarged cross-sectional view of a high pressure coupling depicted in FIG. 2.

Referring now to FIG. 3, the high pressure coupling 28 will be described in greater detail. According to one embodiment, the high pressure coupling 28 includes a cylindrical steel housing 30 encasing a non-metallic body 32. The non-metallic body 32 is slightly displaced from a first and second non-metallic washer 34, 36 disposed at opposite ends thereof, thereby forming a pair of air gaps 38, 40 therebetween. The non-metallic body 32 and the first and second non-metallic washers 34, 36 may be formed out of any non-conductive material with high tensile strength, such as, but not limited to, Garolite. A threaded metallic cap 42 having an elongated opening 44 for receiving the isolated part 24A of the fuel line 24 is fixedly mounted on the first non-metallic washer at a distal end of the high pressure coupling 28.

The high pressure coupling 28 further includes a first ferrule 46 fluidly connected to a second ferrule 48 via a relatively thin passageway 50 for transmitting fuel thereto. The isolated part 24A of the fuel line 24 is connected to the first ferrule 46 via the opening 44 of the threaded cap 42, whereas the non-isolated part 24B of the fuel line 24 is connected to the second ferrule 48 via a central opening 52 formed along the housing 30 at a proximal end of the high pressure coupling 28. As can be seen in FIG. 3, the isolated part 24A of the fuel line 24 has a smaller diameter than that of the opening of the threaded cap. As such, the isolated part 24A of the fuel line 24 may be connected to the first ferrule 46 without contacting the threaded cap 42.

Referring back to FIGS. 1 and 2, the system 2 further includes an ion sensing circuit 54 for measuring the concentration of ions in the combustion chamber 14. The ion sensing circuit 54 comprises a power supply such as, but not limited to, a DC power supply 56 having a preset voltage. The DC power supply 56 is electrically connected to the fuel injector body 12A via a positive terminal 58 and is electrically connected to the engine body 16 via a negative terminal 60. The ion sensing circuit 54 further includes a resistor 62 for sensing an ion current. In addition, since ionization signals tend to be relatively weak, a signal conditioning unit 64 may be provided for filtering or amplification purposes. The signal conditioning unit 64 may be integrated with low pass filters and/or high pass filters to reshape an incoming ion signal. Moreover, while the signal conditioning unit 64 is depicted as forming part of the ion sensing circuit 54, it is to be understood that the signal conditioning unit 64 may be provided as a separate component, or integrated with the ECU 19. A voltage measuring device such as, but not limited to, a potentiometer 66 is electrically connected across the resistor 62 to measure the ion current. The potentiometer 66 is also electrically connected to the ECU 19 and is configured to send an ionization signal thereto.

In operation, the ECU 19 transmits an injection command to the solenoid 15, thereby causing an energizing current to pass through the solenoid 15 to drive the needle. In turn, fuel is injected from the nozzle 17 into the combustion chamber 14. The injected fuel mixes with hot compressed air to bring about fuel combustion. During the combustion process, a plurality of positive and negative ions are formed within the combustion chamber. To detect the ionization content, the DC power supply 56 applies an electric voltage to the fuel injector body 12A. The application of the voltage enables the plurality of ions to generate an ion current which subsequently flows along a path containing the resistor 62. The potentiometer 66 measures the voltage drop across the resistor 62, and outputs a signal representative of the ion current to the ECU 19. Additionally, the ionization signal may be passed through the signal conditioning unit 64 for filtering or amplification purposes.

Figure 10:
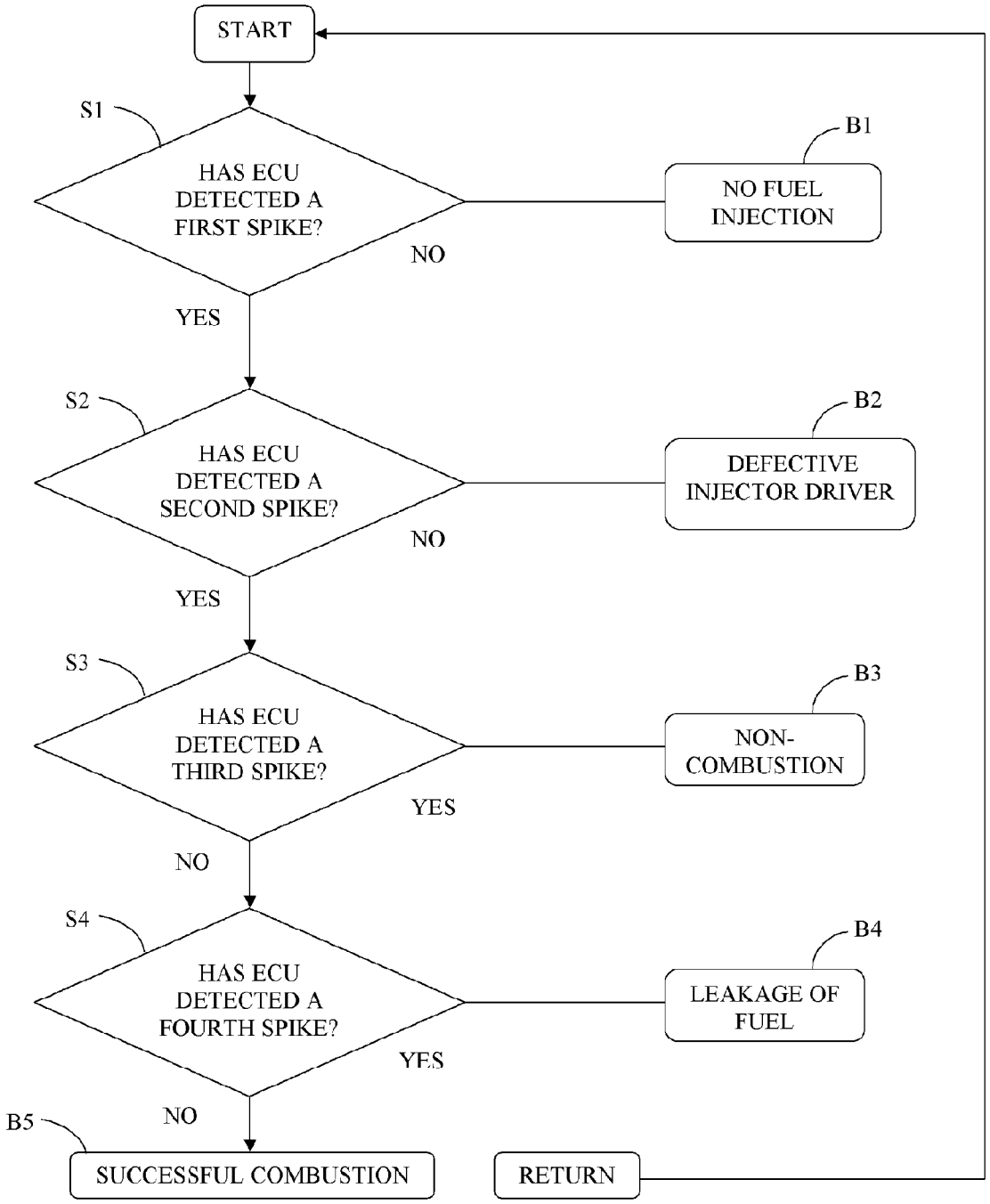
FIG. 10 is a flowchart illustrating the functional steps of an electronic control unit.

As will be described in greater detail below, the functional operation of the ECU 19 may be based on spikes observed in the ionization signal. FIG. 10, for instance, is a flow chart explaining the steps the ECU 19 may carry out to determine various operating conditions of the engine. In step S1, the ECU 19 initially determines whether or not a first spike in the ionization signal has been detected in the ionization signal. If the ECU 19 does not detect a first spike, then the ECU 19 concludes that the fuel injector 12 has not injected fuel into the combustion chamber 14, as indicated in block B1. If the ECU 19 does detect a first spike in the ionization signal, the ECU 19 proceeds to step S2. In step S2, the ECU 19 determines whether or not a second spike in the ionization signal has been detected. More specifically, the ECU 19 determines whether the amplitude of a second spike (the second spike indicates the end of fuel injection) in the ionization signal is greater than a predetermined value. If not, the ECU 19 concludes that the fuel injector driver is defective (e.g., the fuel injector 12 may be injecting too much fuel), as indicated in block B2. If so, the ECU 19 proceeds to step S3.

In step S3, the ECU 19 determines whether a third spike in the ionization signal has been detected. If not, the ECU 19 concludes that combustion has not occurred (e.g., due to the occurrence of a misfire or abnormal burning), as indicated in block B3. If the ECU 19 detects a third spike in the ionization signal, the ECU 19 concludes that combustion has occurred. Nonetheless, the ECU 19 proceeds to step B4 and determines whether or not a fourth spike has been detected in the ionization signal. If so, then the ECU 19 concludes that a leakage of fuel has occurred during the expansion cycle, as indicated in block B4. If not, then the ECU 19 concludes that the injection of fuel and the combustion thereof is successful, as indicated in block B5. Accordingly, based on the existence or non-existence of a spike in the ionization signal, the engine may be controlled to modify various conditions such as the combustion mode, ignition timing, fuel injection timing, quantity of fuel being injected, etc.

FIGS. 4A-4D illustrate waveforms corresponding to various signals during operation of a diesel engine. In particular, the foregoing figures depict a waveform of a signal indicative of a pressure trace 100, a needle lift position 102, a rate of a heat release trace 104, and an ion current 106 (i.e., the output of the potentiometer 66) during a cycle of the engine. The graphs in FIGS. 4A-4D are based on engine simulations according to a start-of-injection pulse preset to 8.25 Crank Angle Degrees (CAD) before Top Dead Center (TDC).

Figure 4A:
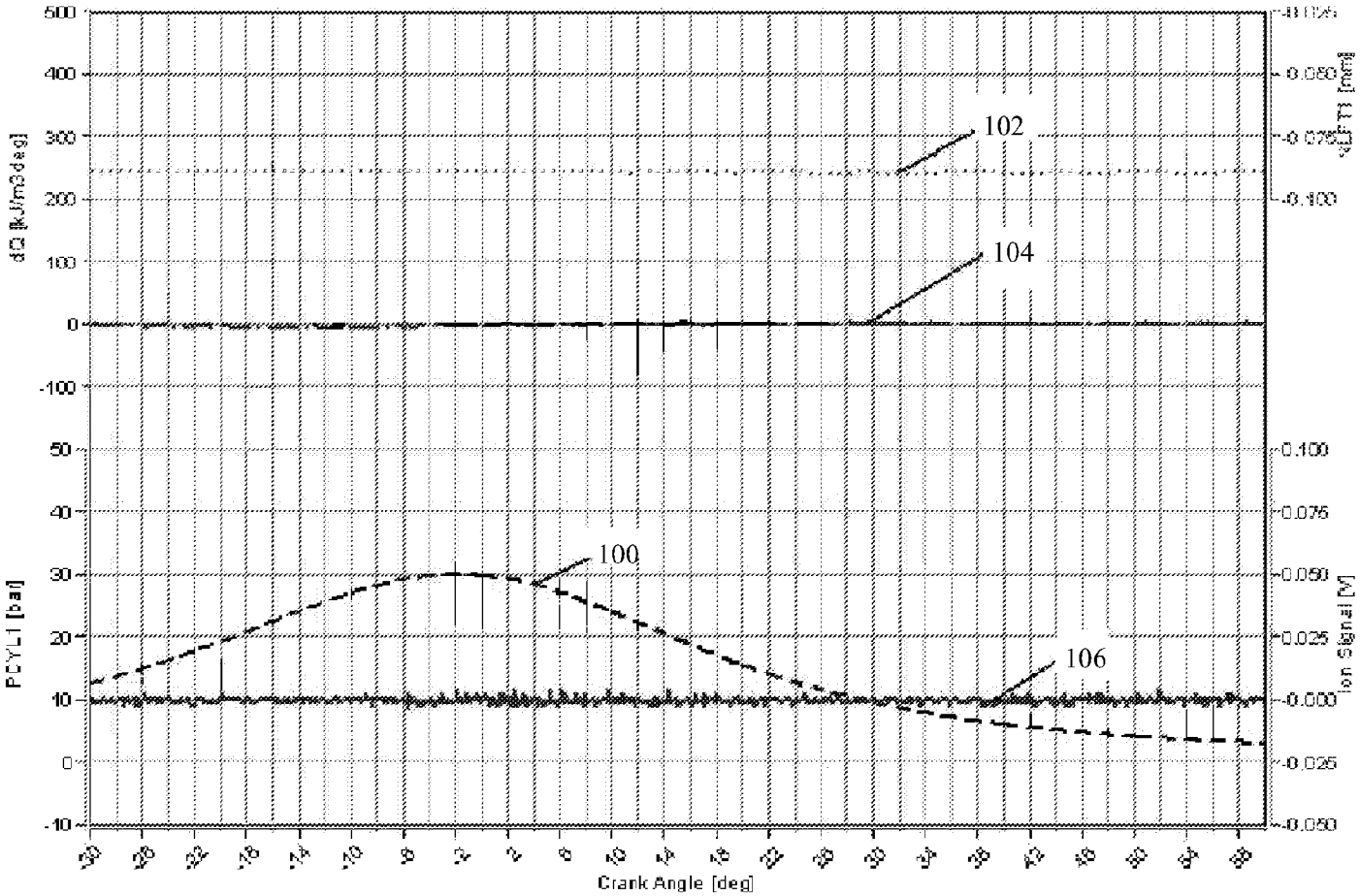
FIGS. 4A-4D are waveform diagrams illustrating combustion pressure and ionization current signals versus engine piston crank angle signals.

Referring first to FIG. 4A, the pressure trace signal 100 indicates the level of compression of an engine cylinder (not shown). It can be seen that since the needle lift signal 102 displays no information, fuel has not been injected into the combustion chamber 14 yet. As such, the heat release trace 104 signal and the ionization signal 106 similarly indicate that no activity is taking place inside the combustion chamber 14.

Figure 4B:
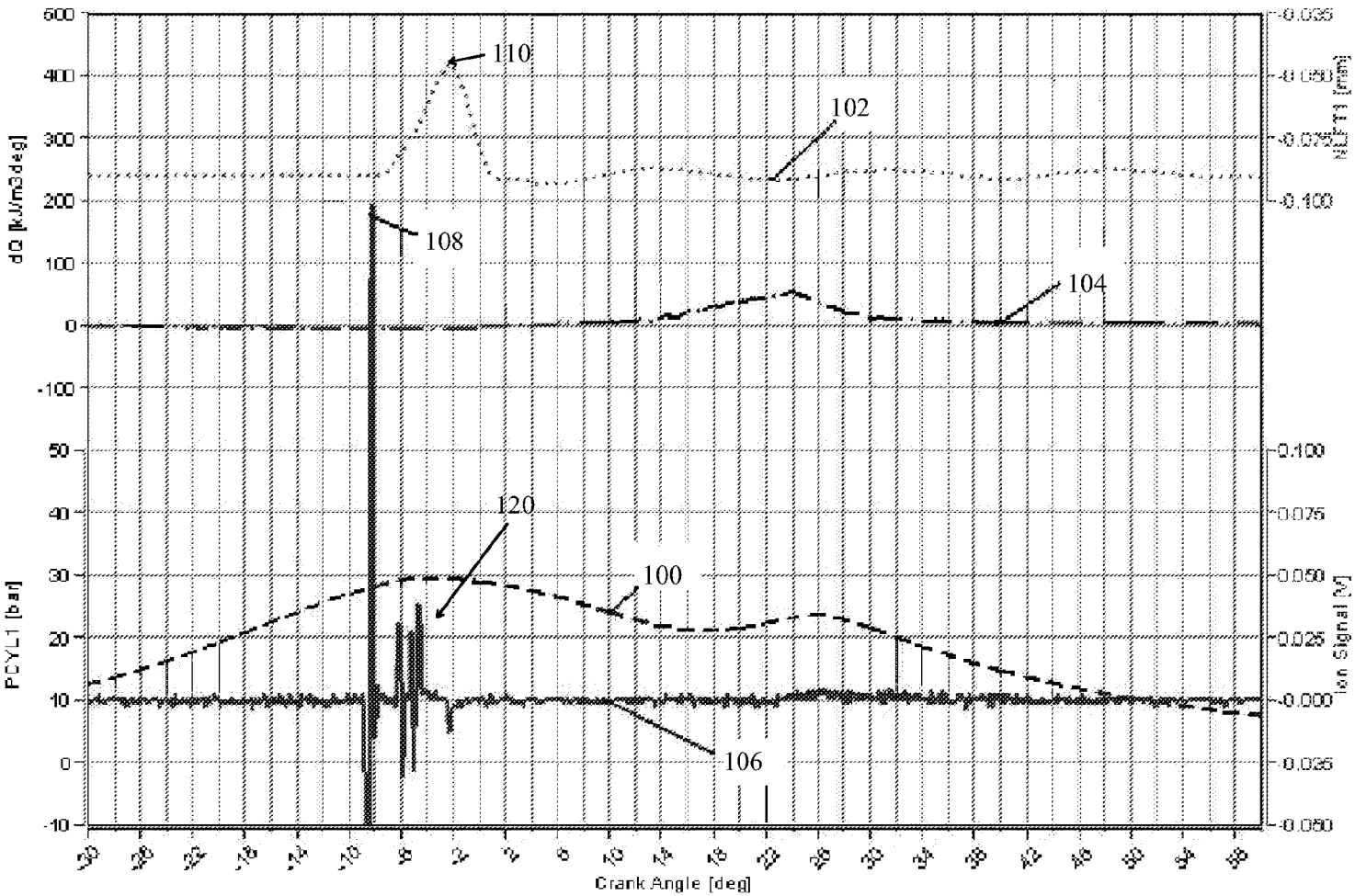

Referring now to FIG. 4B, a waveform diagram is shown illustrating the results of an initial firing cycle in the engine during a cold start. In particular, the pressure trace signal 100 indicates a late firing (partial misfiring) and the heat release trace signal 104 indicates a relatively low heat release with respect to the fuel injected into the combustion chamber 14. The ionization signal 106 peaks at exactly 8.25 CAD before TDC. This peak refers to the start-of-injection pulse and hereinafter will be referred to as the start-of-injection spike 108, whereas the second peak in the ionization signal 106 refers to the end-of-injection pulse and hereinafter will be referred to as the end-of-injection spike 120.

In FIG. 4B, the start-of-injection spike 108 primarily indicates interference caused by the energizing current flowing through the solenoid 15. As previously described, the fuel injector 12 is connected to a preset positive potential 58 and contains the solenoid 15, which is electrically insulated from the fuel injector 12. Thus, the energized fuel injector 12 is operable to detect current passing through the solenoid 15 since any current flowing through the fuel injector 12 will cause a disturbance in the voltage of the fuel injector body 12A. In this manner, the fuel injector 12 is operable to serve as a current probe.

For instance, the needle lift signal 102 depicted in FIG. 4B indicates a spike 110 almost immediately after the start-of-injection spike 108. The delay between the spikes 108 and 110 is attributable to the time consumed by the solenoid 15 to drive the needle upon becoming energized. Looking at the overall ionization signal 106 during this cycle, a few notable conclusions can be drawn. First, it can be seen that fuel has been successfully injected into the combustion chamber 14 due to the presence of the start-of-injection spike 108. Secondly, however, it can be seen that the fuel injector driver is defected since the amplitude of the end-of-injection spike 120 is nearly zero, which indicates that too much fuel (i.e., more fuel than specified by the ECU 19) has been injected into the combustion chamber 14. Furthermore, it can also be seen that abnormal burning or a misfire has occurred due to the absence of an additional spike in the ionization signal 106.

Figure 4C:
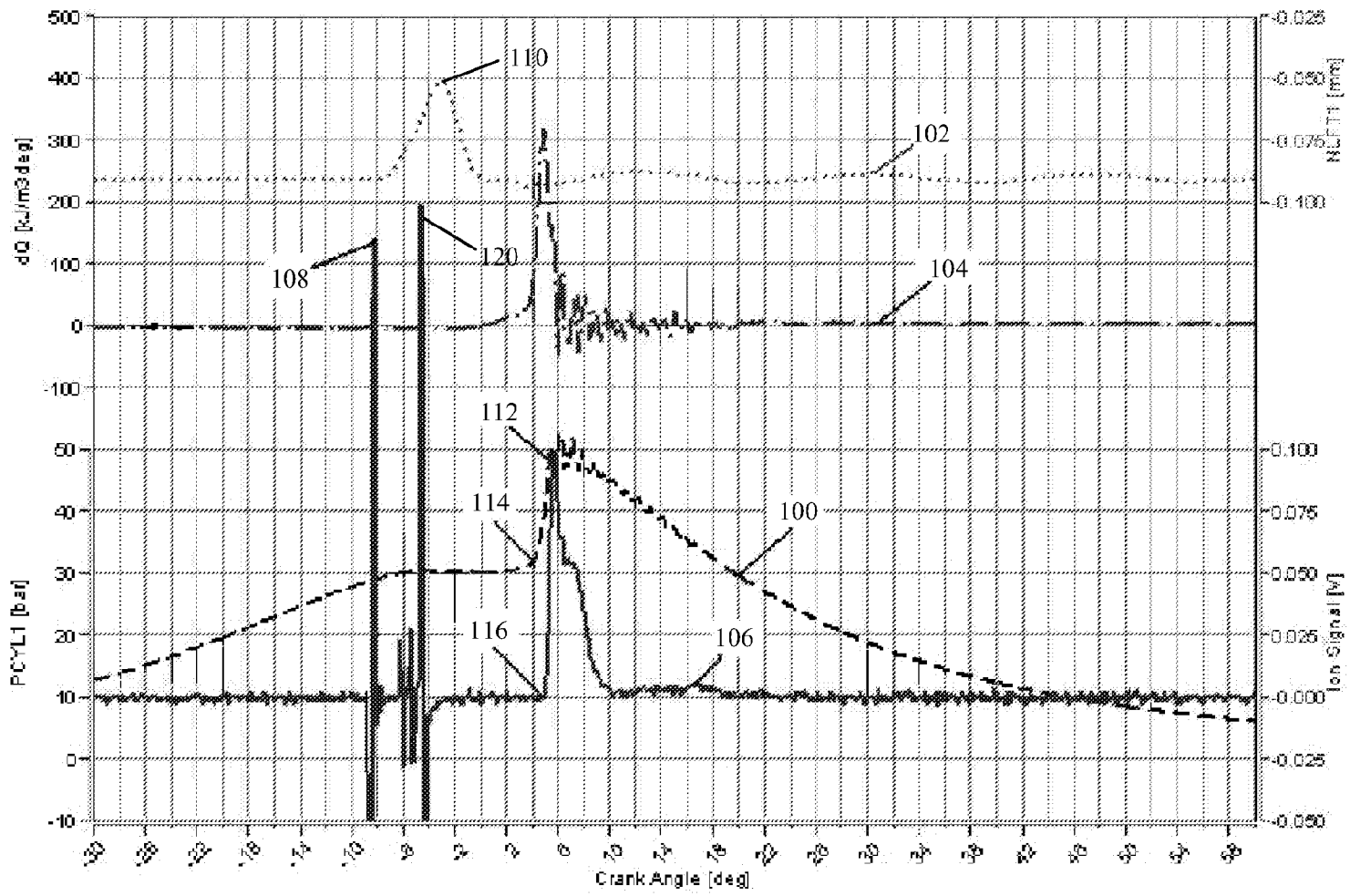

Turning now to FIG. 4C, a waveform diagram is shown illustrating the results of a successful combustion cycle. In contrast to FIG. 4B, the heat release trace signal 104 indicates a relatively high release rate, and the amplitude of the end-of-injection spike 120 indicates that the fuel injector 12 is operating normally (i.e., the fuel injector 12 is injecting the quantity of fuel specified by the ECU 19). While the start-of-injection spike 108 is similarly observed at 8.25 CAD before TDC, a third peak in the ionization signal 106 occurs at approximately 7 CAD after TDC. The third peak 112 indicates the start of combustion and will hereinafter be referred to as the start-of-combustion spike 112. The presence of the start-of-injection spike 108 and the start-of-combustion spike 112 in the ionization signal 106 indicates a successful combustion cycle. Additionally, the start-of-injection and start-of-combustion spikes 108 and 112 can be used to calculate the ignition delay, which can subsequently be communicated as feedback information to the ECU 19. Calculation of the ignition delay may be particularly helpful in the control of HCCI engines. Similarly, information regarding the amplitudes of the start-of-injection and end-of-injection spikes 108 and 120, as well as the distance between these spikes, can be communicated as feedback to the ECU 19 in order to determine the amount of amount of fuel injected and monitor the integrity of the fuel injection system 10.

Figure 4D:
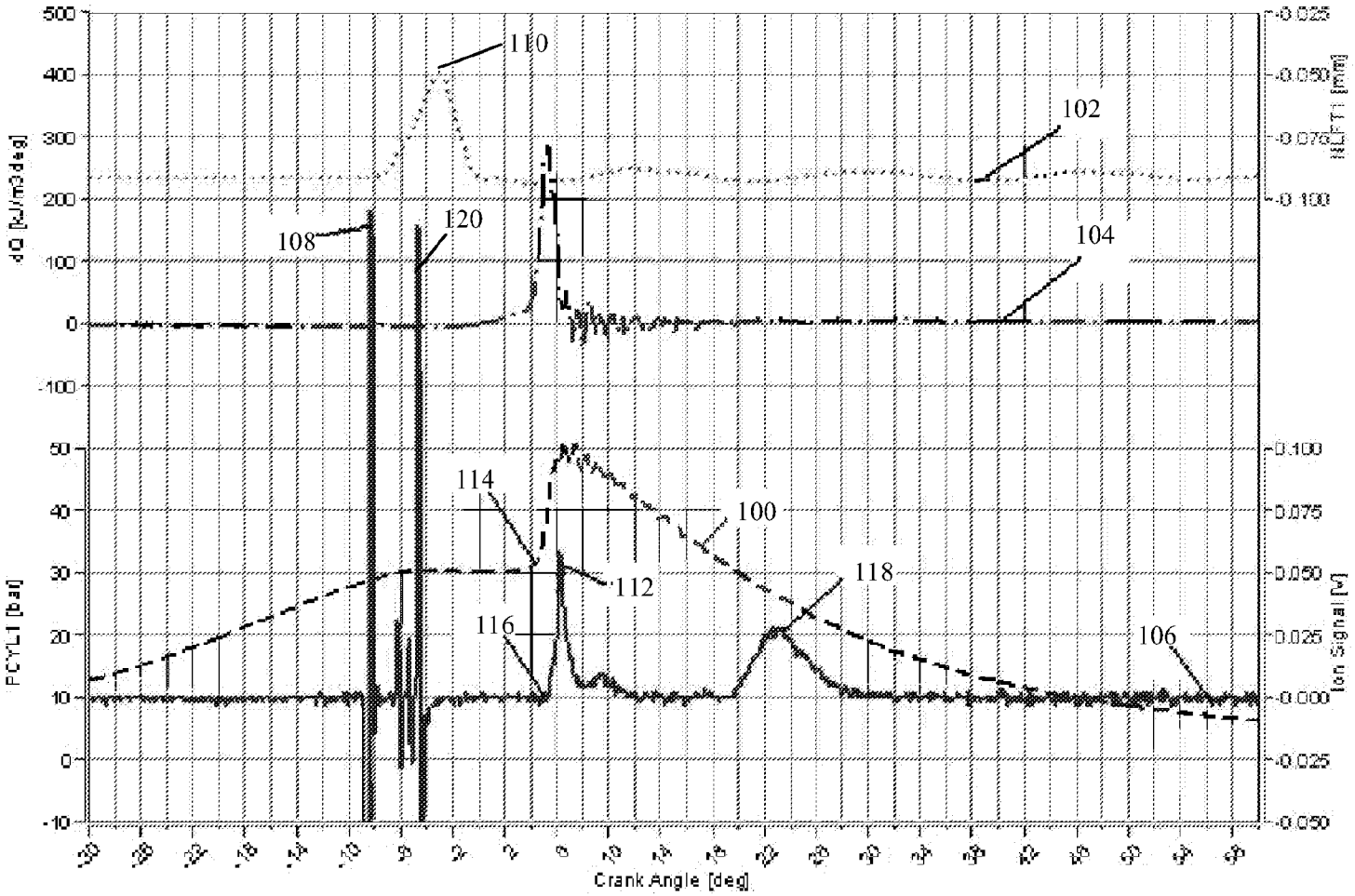

Referring now to FIG. 4D, the results are generally identical to those illustrated in FIG. 4C with the exception of a fourth spike 118 in the ionization signal 106 occurring relatively late in the expansion stroke of the engine cycle. The fourth spike 118 indicates fuel droplets that have exited the nozzle 17 and burned locally in the high temperature environment near the body of the fuel injector 12. Since burning of fuel effectuates the formation of ions, the fuel injector 12, which is configured as an ion sensor, is operable to detect fuel leaks during the expansion cycle.

Based on the foregoing, the ECU 19 can be configured to utilize information obtained from the ionization signal to efficiently control various engine operating conditions. For instance, the ECU 19 can use such information to control the injection of fuel, as well as to control other systems to enhance engine performance, achieve better fuel economy, and lower exhaust emissions.

Figure 5A:
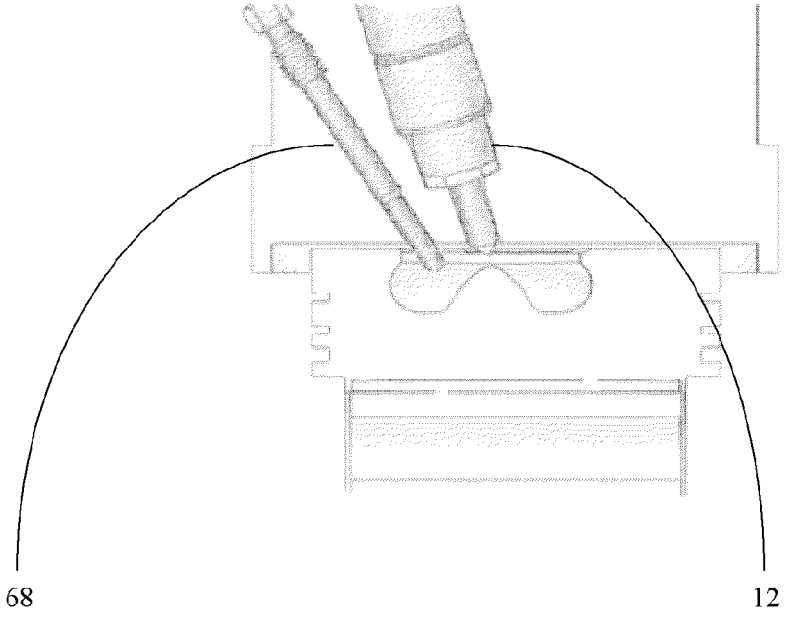
FIG. 5A is a schematic view of a glow plug integrated with a fuel injector within a combustion chamber.

Referring now to FIG. 5A, a glow plug 68 is shown as being integrated with the fuel injector 12 inside the combustion chamber 14. The glow plug 68 includes a second ion sensor located in an orifice of the glow plug 68. The integration of the glow plug 68 with the fuel injector 12 may be implemented to measure an additional ionization signal during the combustion process. As a result, engine performance may be enhanced without the necessity of drilling additional holes in the cylinder head of the engine. It should be understood to those of ordinary skill in the art that a spark plug can similarly be implemented as a second ion sensor in spark-ignited engines.

Figure 5B:
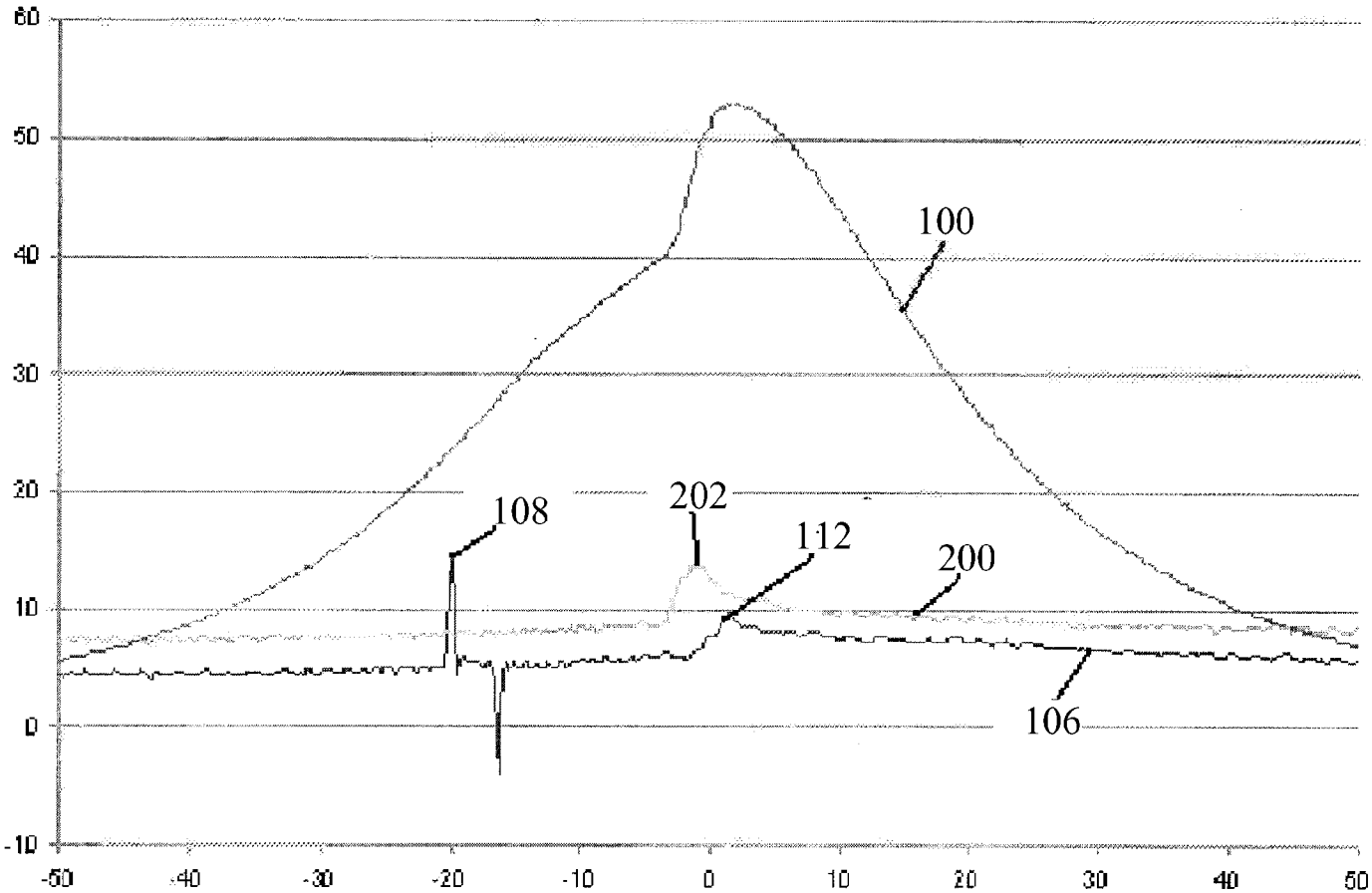
FIG. 5B is a waveform diagram illustrating a signal transmitted by an ion sensor disposed within an orifice of the glow plug of FIG. 5A versus a signal transmitted by the fuel injector of FIG. 5A.

As can best be seen in FIG. 5B, the ionization signal 106 indicative of the ion current measured by the fuel injector 12 indicates a start-of-injection spike 108 and a start-of-combustion spike 112. With regard to the start-of-combustion spike 112, however, it can be seen that the ionization signal 200 indicative of the ion current measured by the second ion sensor located in the glow plug 68 indicates a start-of-combustion spike 202 occurring slightly before the start-of-combustion spike 112. Accordingly, the foregoing information can be used to conclude that the combustion process began near the glow plug orifice prior to beginning near the body of the fuel injector 12.

Figure 6:
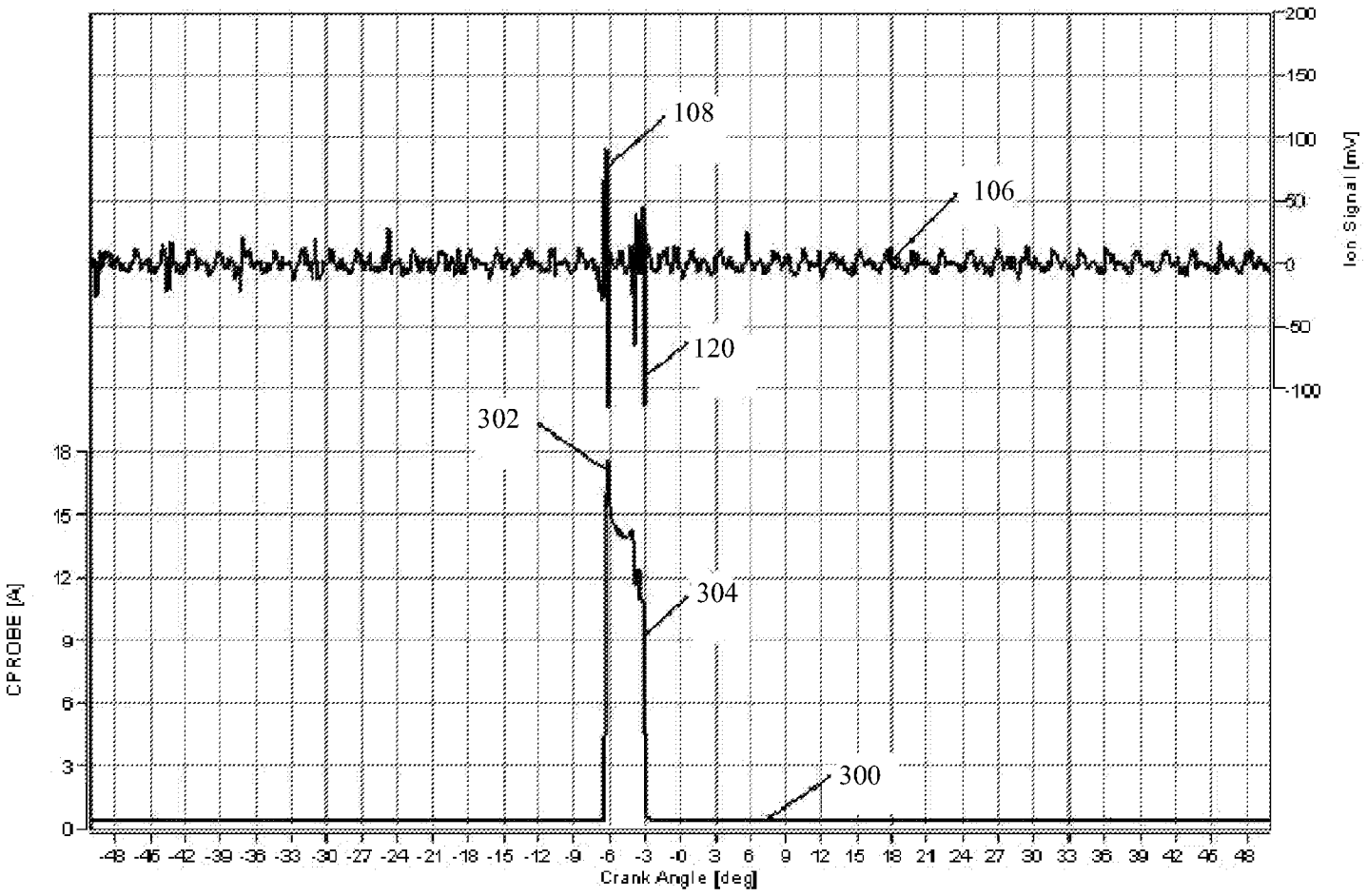
FIG. 6 is a waveform diagram illustrating the results of implementing a current probe with the system of the present invention.

As previously discussed, the fuel injector 12 according to the present invention is operable to function as a current probe. FIG. 6, for instance, illustrates the results of connecting a current probe (not shown) to the fuel injector 12. The results are based on a simulation in which an electric pulse signal is sent to the solenoid 15 at 6 CAD before TDC, and wherein fuel is not injected into the combustion chamber 14. The signal corresponding to the fuel injector 12 is the ionization signal 106, whereas the signal corresponding to the current probe is denoted by reference numeral 300 and will hereinafter be referred to as the current probe signal 300. Point 302 of the current probe signal 300 indicates the start-of-injection pulse detected by the current probe, and point 304 indicates the end-of-injection pulse detected by the current probe. Notably, a comparison of the ionization signal 106 and the current probe signal 300 illustrates a near identical correlation between the start-of-injection pulse 108 and end-of-injection pulse 120 detected by the fuel injector 12 and the start-of-injection pulse 302 and end-of-injection pulse 304 detected by the current probe. Accordingly, the results of FIG. 6 confirm that the fuel injector 12 of the present invention can detect the electric injection pulse signal transmitted from the ECU 19 to the solenoid 15.

Figure 7A:
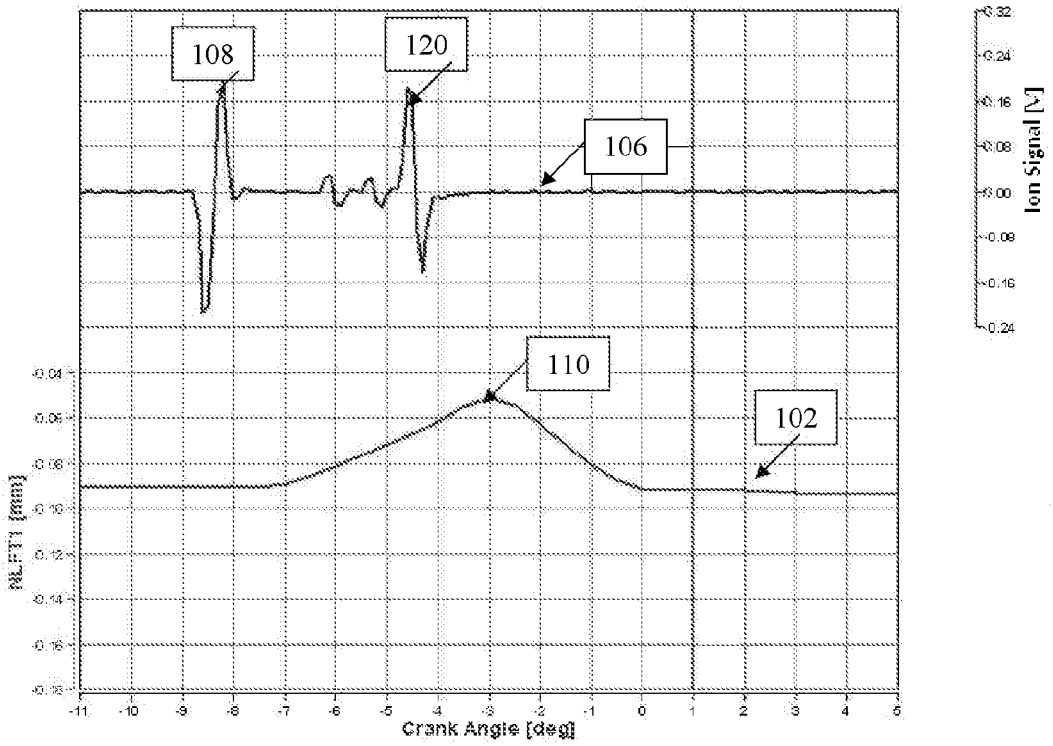
FIG. 7A is a waveform diagram illustrating the results of a normal operating fuel injector driver.
Figure 7B:
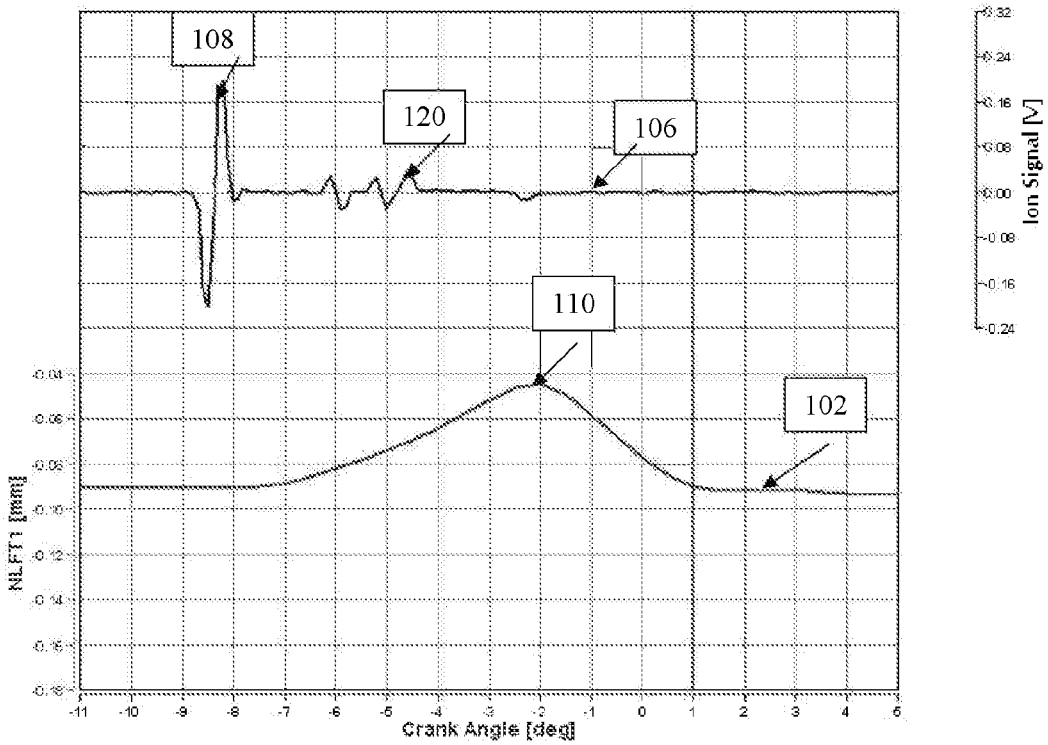
FIG. 7B is a waveform diagram illustrating the results of an abnormally operating fuel injector driver.

Referring now to FIGS. 7A and 7B, waveform diagrams are shown illustrating the difference between a normal operating fuel injector driver and a defective fuel injector driver. FIG. 7A depicts a normal start-of-injection pulse 108 and a normal end-of-injection pulse 120 detected by the fuel injector 12. The corresponding needle lift signal 102 begins at 7 CAD before TDC and ends at TDC with an amplitude of approximately 0.05 mm. FIG. 7B depicts the results of an engine running with the same electric pulse width signal requested by the ECU 19 and the same operating conditions as in FIG. 7A. While the start-of-injection pulse 108 is similarly observed at about 8.25 CAD before TDC, the amplitude of the end-of-injection pulse 120 is near zero. In addition, although the corresponding needle lift signal 102 similarly begins at 7 CAD before TDC, it ends at 1 CAD after TDC with a higher amplitude of approximately 0.55 mm. Furthermore, it can be seen that the needle lift signal 102 shown in FIG. 7B is higher and wider than in FIG. 7A. The results of FIG. 7B therefore indicate a defective fuel injector driver since more fuel has been injected despite the fact that the engine operating conditions are the same as in FIG. 7A.

Figure 8A:
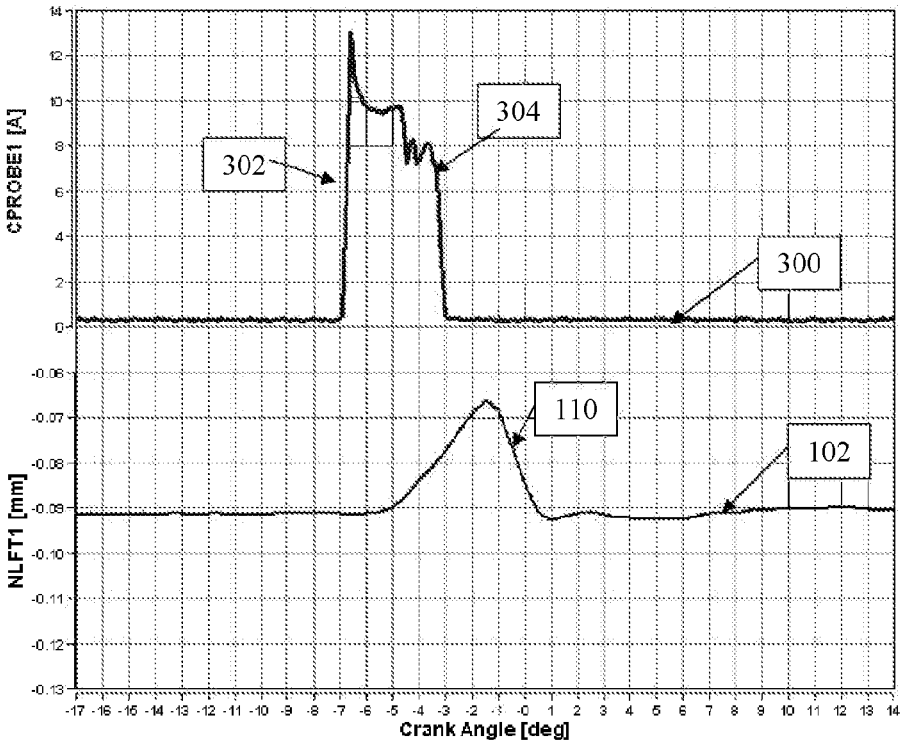
FIG. 8A is a waveform diagram illustrating the results of implementing a current probe with the fuel injector driver employed in FIG. 7A.
Figure 8B:
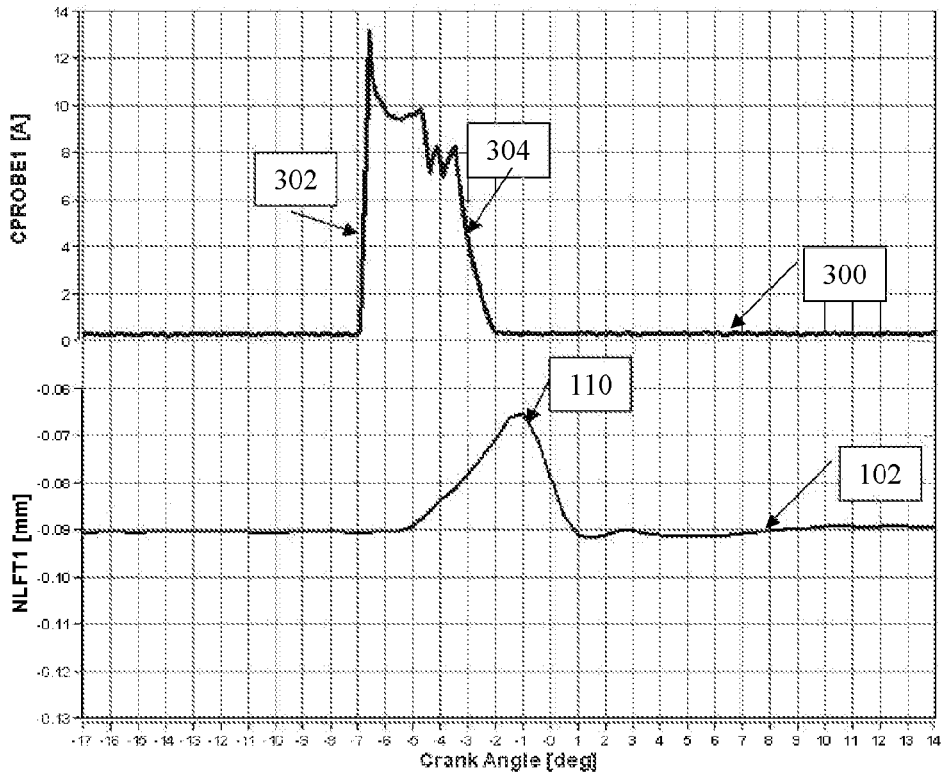
FIG. 8B is a waveform diagram illustrating the results of implementing a current probe with the fuel injector driver employed in FIG. 7B.

FIGS. 8A and 8B illustrate the results of connecting a current probe (not shown) to the fuel injector 12. The results are based on the same engine operating conditions employed in FIGS. 7A and 7B. FIG. 8A depicts the current probe signal 300 corresponding to FIG. 7A, which reflects a normal functioning fuel injection driver. FIG. 8B, on the other hand, depicts the current probe signal corresponding to FIG. 7B, which reflects an abnormally functioning fuel injector driver. For instance, although the start-of-injection pulse 302 of the current probe signal 300 in FIG. 8B is the same as in FIG. 8A, the end-of-injection pulse 304 of the current probe signal 300 in FIG. 8B is different. Specifically, the end-of-injection pulse 304 of the current probe signal 300 in FIG. 8B has a slower decaying slope than the end-of-injection pulse 304 in FIG. 8A, which indicates a defect in the fuel injector driver.

Figure 9:
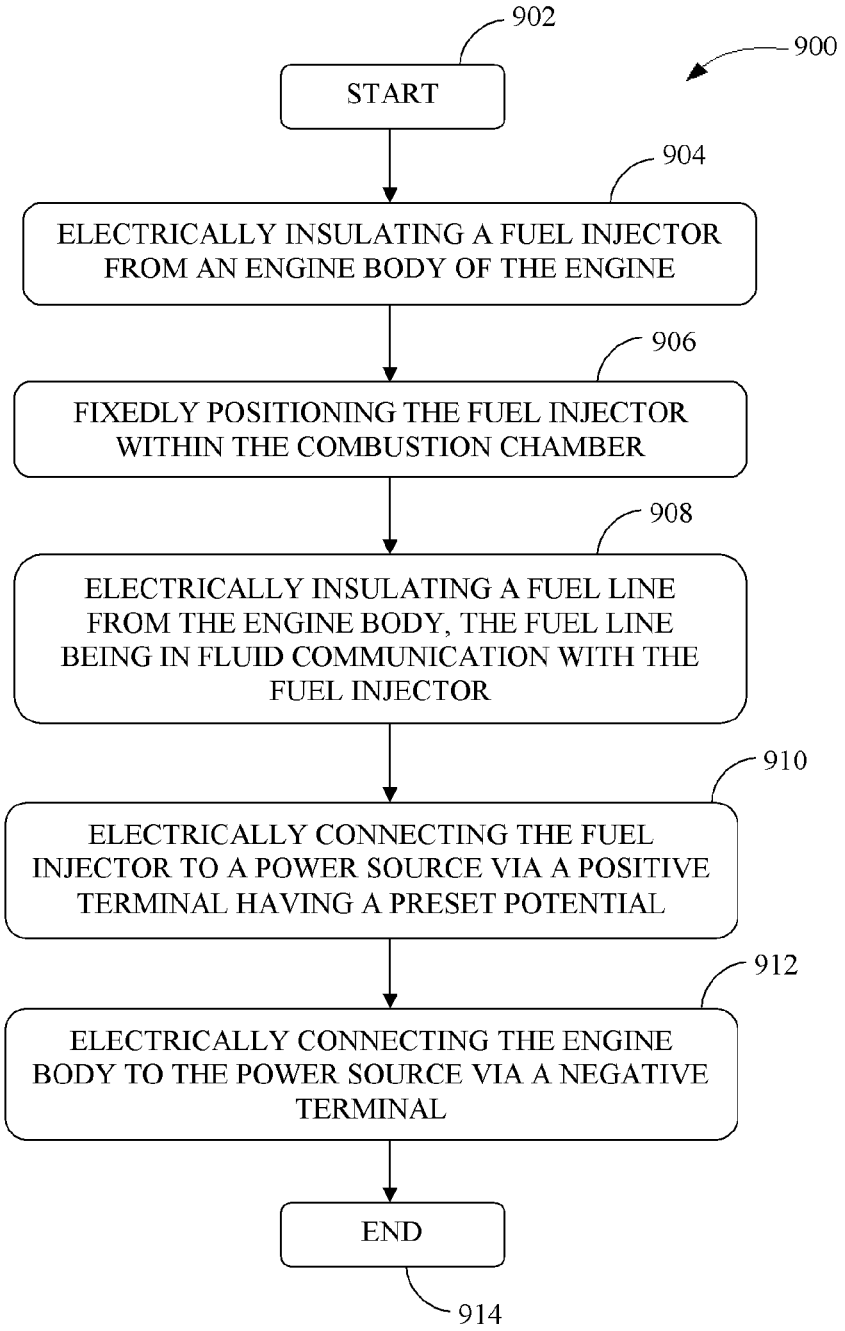
FIG. 9 is a flowchart illustrating a method of making an ion sensing apparatus in accordance with the present invention.

Referring now to FIG. 9, a method 900 of making an ion sensing apparatus for detecting ionization current in a combustion chamber 14 of an engine starts in step 902. The components of the ion sensing apparatus which are identical to those corresponding to the ion sensing system 10 discussed above, are denoted by like reference characters and will not be described in detail below.

In step 904, a fuel injector 12 is electrically insulated from an engine body 16 of the engine. This may be accomplished according to various techniques known to those of ordinary skill in the art. For instance, an insulating member such as the aforementioned ceramic washer 18 may be disposed between the fuel injector 12 and the engine body 16. In step 906, the fuel injector 12 is fixedly positioned within the combustion chamber 14. For instance, a retaining device such as the electrically insulated fork 20 discussed above may be provided to secure the fuel injector 12 in place and ensure electrical isolation between the fuel injector 12 and the engine body 16.

In step 908, a fuel line 24 for supplying fuel to the fuel injector 12 is electrically insulated from the engine body 16. According to one embodiment, the fuel line 12 may be electrically insulated from the engine body 16 by way of the ceramic ferrule 26. As previously discussed, the ferrule 26 may be disposed between a proximal end of the fuel line 14 and a fuel pump 22 operable to supply fuel thereto. Alternatively, an isolated part 24A of the fuel line 24 may be electrically insulated from the engine body 16 by way of an insulating device such as the high pressure coupling 28 discussed above. It should be understood to those of ordinary skill in the art that the isolation between the fuel line 24 and the fuel injector 26 can be done for every fuel injector associated with a given cylinder of an engine. Alternatively, the entire common rail may be insulated by way of an isolating member such as the ferrule 26 or high pressure coupling 28, such that a single isolating member is necessary.

Continuing with step 910, the fuel injector is electrically connected to a power source via a positive terminal 58 having a preset potential. The power source may be the DC power source 56 discussed above. In step 912, the engine body 16 is electrically connected to the power source 56 via a negative terminal 60. The method ends in step 914.

While the above description constitutes the preferred embodiment of the present invention, it will be appreciated that the invention is susceptible to modification, variation and change without departing from the proper scope and fair meaning of the accompanying claims.

I claim:

1. A sensing system for detecting current in an internal combustion engine having at least one cylinder, the sensing system comprising:

a fuel injector for injecting fuel into the combustion chamber, the fuel injector being fixedly positioned within the combustion chamber and electrically insulated from an engine body of the internal combustion engine; and a sensing circuit for measuring current, the circuit including a power source for supplying power to the fuel injector, the sensing circuit being configured to identify an electro-magnetic disturbance in the sensing circuit caused by operation of the fuel injector and determine a fuel injector operational status based on the electro-magnetic disturbance, wherein the power source is electrically connected to the fuel injector via a positive terminal, the positive terminal having a preset potential, and wherein the power source is electrically connected to the engine body via a negative terminal.

2. The sensing system of claim 1, further comprising a fuel line in fluid communication with the fuel injector and operable to transmit fuel thereto, the fuel line being electrically insulated from the engine body.

3. The sensing system of claim 1, wherein a common fuel line in communication with every fuel injector in an engine is electrically insulated from the engine body by way of a single isolating member.

4. The sensing system of claim 1, wherein the fuel injector includes a solenoid operable to selectively drive a needle for injecting fuel into the cylinder, the solenoid terminals being electrically insulated from an injector body of the fuel injector.

5. The sensing system of claim 4, wherein the sensing circuit is operable to detect an electric injection pulse signal including a start of injection pulse or an end of injection pulse transmitted from an electronic control unit to the solenoid through the electro-magnetic disturbance.

6. The sensing system of claim 1, further comprising a resistor disposed between the positive terminal and the negative terminal, wherein ionization current is detected by measuring a voltage drop across the resistor.

7. The sensing system of claim 1, wherein the sensing circuit comprises a first ion sensor and the sensor system further comprises a second ion sensor for sensing a second ion signal and being disposed within an orifice of a glow plug or of a spark plug, the glow plug or spark plug being disposed within the combustion chamber.

8. The sensing system of claim 4, wherein the electro-magnetic disturbance being generated by current passing through the solenoid of the fuel injector.

9. The sensing system of claim 5, wherein the electro-magnetic disturbance information on the amplitudes of start of injection and end of injection pulses and on the distance between those pulses, is used to determine the amount of fuel injected.

10. The sensing system of claim 9, operable to detect proper operation and defective operation of fuel injector driver combustions in response to the electro-magnetic disturbance.

11. The sensing system of claim 1, wherein the sensing circuit is operable to detect the quality of the combustion process, including at least one of engine misfire, abnormal burning, or normal combustions in response to the electro-magnetic disturbance.

12. The sensing system of claim 1, wherein the sensing circuit is operable to detect fuel leakage or fuel droplets exiting the injector nozzle and burned near the fuel injector body in response to the electro-magnetic disturbance.

13. The sensing system of claim 1, further comprising an electronic control unit operable to monitor at least one of operation of the fuel injection system or the quality of the combustion process determined in response to the electro-magnetic disturbance, the electronic control unit operatively connected to the fuel injector and operable to control the injection of fuel by transmitting energizing signals to the fuel injector.

14. The sensing system of claim 1, wherein the sensing circuit is operable to detect the ignition delay between a start of fuel injection pulse in response to the electro-magnetic disturbance and a start of combustion spike.

15. A sensing system for detecting current in an internal combustion engine having at least one cylinder, the sensing system comprising:

a fuel injector for injecting fuel into the combustion chamber, the fuel injector being fixedly positioned within the combustion chamber and electrically insulated from an engine body of the internal combustion engine; and a ion sensing circuit for measuring ionization in the at least one cylinder, the ion sensing circuit being configured to identify an electro-magnetic disturbance in the ion sensing circuit caused by actuation of a solenoid of the fuel injector and determine a fuel injector operational status based on the electro-magnetic disturbance.

* * * * *